US006408923B1

(12) United States Patent
Nien

(10) Patent No.: US 6,408,923 B1
(45) Date of Patent: Jun. 25, 2002

(54) VERTICAL BLIND

(76) Inventor: Ming Nien, No. 11, Kungchu Rd., Fangyuan Industrial Dist., Houliao Village, Fangyuan Hsiang, Changhua Hsien (TW)

( * ) Notice: Subject to any disclaimer, the term of this patent is extended or adjusted under 35 U.S.C. 154(b) by 0 days.

(21) Appl. No.: 09/790,363

(22) Filed: Feb. 21, 2001

(51) Int. Cl.[7] ..... E06B 9/36
(52) U.S. Cl. ..... 160/168.1 V; 160/173 V
(58) Field of Search ..... 160/168.1 V, 173 V; 292/300, DIG. 15, 23, 70; 16/86 R, 86 A, 176.1 V, 177 V, 178.1 V

(56) References Cited

U.S. PATENT DOCUMENTS 469,968 A * 3/1892 Frisbie
2,885,237 A * 5/1959 Heyer
3,231,847 A * 1/1966 Kressel
3,675,959 A * 7/1972 Hansen et al.
4,291,738 A * 9/1981 Grenga et al.
5,445,205 A * 8/1995 Hansen
5,992,495 A * 11/1999 Cadorette

* cited by examiner

*Primary Examiner*—Blair M. Johnson
(74) *Attorney, Agent, or Firm*—Kolisch Hartwell Dickinson McCormack & Heuser

(57) ABSTRACT

A vertical blind has two end pieces respectively attached to opposite ends of a track. The track is adapted to be mounted on a ceiling. The vertical blind includes multiple clamps partially slidably received in the track to clamp vertical slats. Each clamp includes a shoulder vertically formed and has at least one through hole defined in the shoulder parallel to the track. At least one rod extends perpendicular from the faceplate and aligns with the through hole in the shoulder on the clamp. The rod has an enlarged head formed on a free end and a groove diametrically defined in the enlarged head. The rod holds the nearest clamp in place after the enlarged head passes through the through hole. The end piece of the present invention is easily made and assembled to save time and cost of manufacturing.

1 Claim, 5 Drawing Sheets

VERTICAL BLIND

BACKGROUND OF THE INVENTION

1. Field of the Invention

The present invention relates to a vertical blind, and more particularly to a vertical blind that includes two end pieces mounted in two opposite ends of a track. The end piece is one integral piece and is easily installed.

2. Description of Related Art

With reference to FIGS. 4 and 5, a conventional vertical blind in accordance with the prior art comprises a track (40) adapted to be mounted on a ceiling. The transverse cross section of the track (40) is an inverted U-shape, and the track (40) includes two sides each having a lateral rail (41) formed inwardly on the lower end of the track (40). An end piece (60) is attached to each end of the track (40). A shaft (42) extends through multiple clamps (43) and includes two ends respectively secured in the corresponding end piece (60). The clamp (43) is slidably mounted on the rail (41) in the track (40) and clamps a vertical slat (50). The clamp (43) has a plate (431) vertically received inside the track (40). A holder (70) is mounted on each end piece (60) to hold the nearest clamp (43) in place.

The end piece (60) includes a protrusion (61) extending into the track (40) and a hole (62) defined in the protrusion (61) to receive the end of the shaft (42). The protrusion (61) is cubic and has two sides each parallel to the side of the track (40). Each side of the protrusion (61) has a groove (610) defined in the top for connecting the holder (70).

The holder (70) includes a bottom plate (71) with two ends each having a side plate (72) extending to abut the side of the protrusion (61) of the end piece (60). A lateral hook (73) extends inward from the free end of the side plate (72) to be received in the groove (610) for mounting the holder (70) on the end piece (60). A bridge (710) extends horizontally from the bottom plate (71) of the holder (70). The bridge (710) includes one side opposite to the bottom plate (71) having two opposite ends each having an arm (74) extending into the track (40). Each of the arms (74) has an indent (75) defined to engage the plate (431) of the nearest clamp (43) to hold the nearest clamp (43) in place.

However, the strength of the holder is weak and easily broken during assembly. The end piece and the holder are two pieces that must be made separately and assembled before attaching the holder to the end of the track. Consequently, the conventional end piece for a vertical blind takes a lot of time and money to manufacture and assemble.

The present invention has arisen to mitigate and/or obviate the disadvantages of the conventional vertical blind.

SUMMARY OF THE INVENTION

The main objective of the present invention is to provide an improved vertical blind that has two integrated end pieces respectively attached to the opposite ends of a track of the vertical blind. The track is adapted to be mounted on a ceiling. The vertical blind comprises multiple clamps partially slidably received in the track for clamping vertical slats. The end pieces secured in two opposite ends of the track holds the nearest clamp in place. A shaft is rotatably received in the track and has two ends each connected to the corresponding end piece. The end piece of the present invention is easily made and assembled to save time and the cost of manufacturing.

Further benefits and advantages of the present invention will become apparent after a careful reading of the detailed description with appropriate reference to the accompanying drawings.

DETAILED DESCRIPTION OF THE INVENTION

Figure 1:
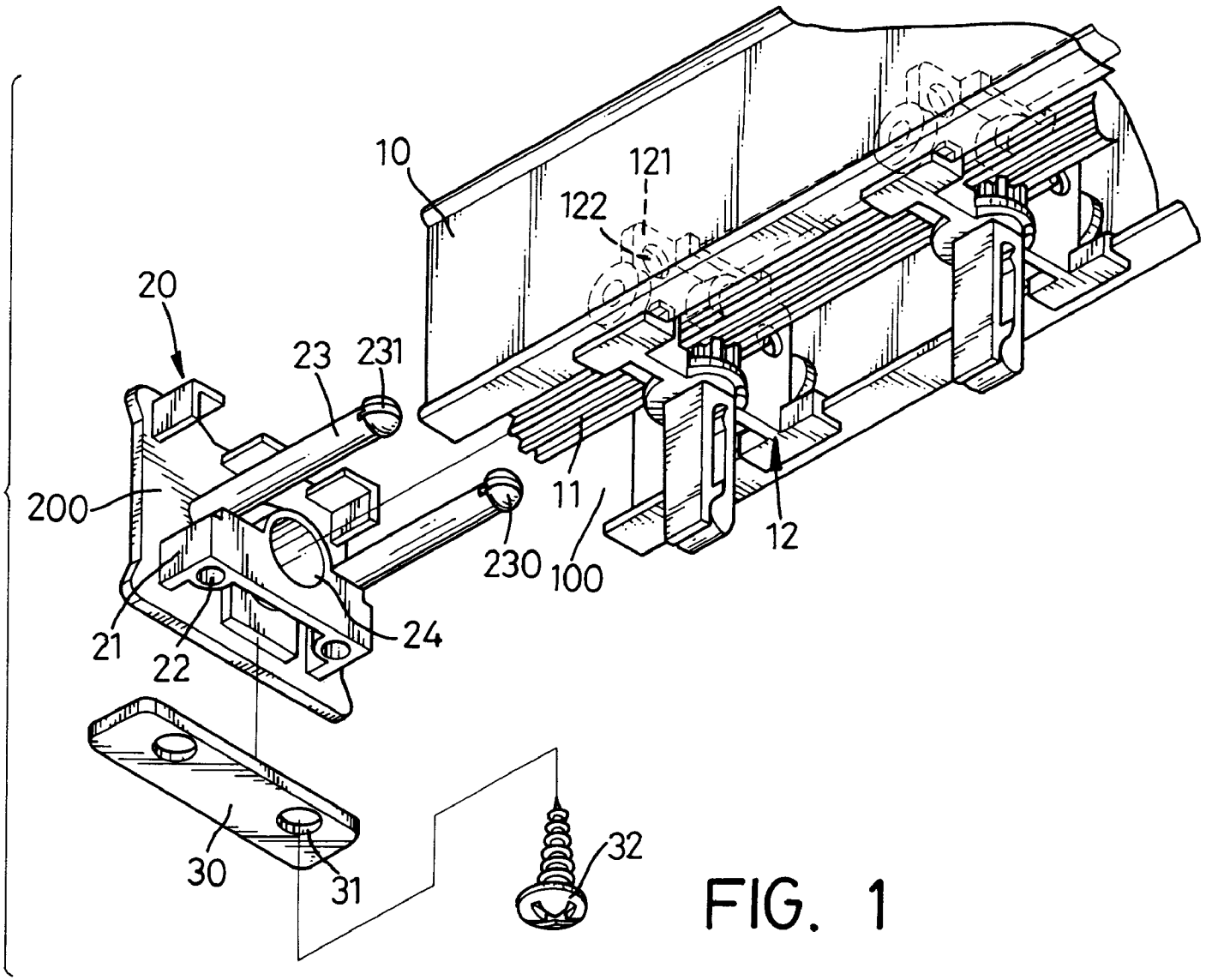
FIG. 1 is a partially exploded perspective view of an end piece and track in a vertical blind in accordance with the present invention.
Figure 2:
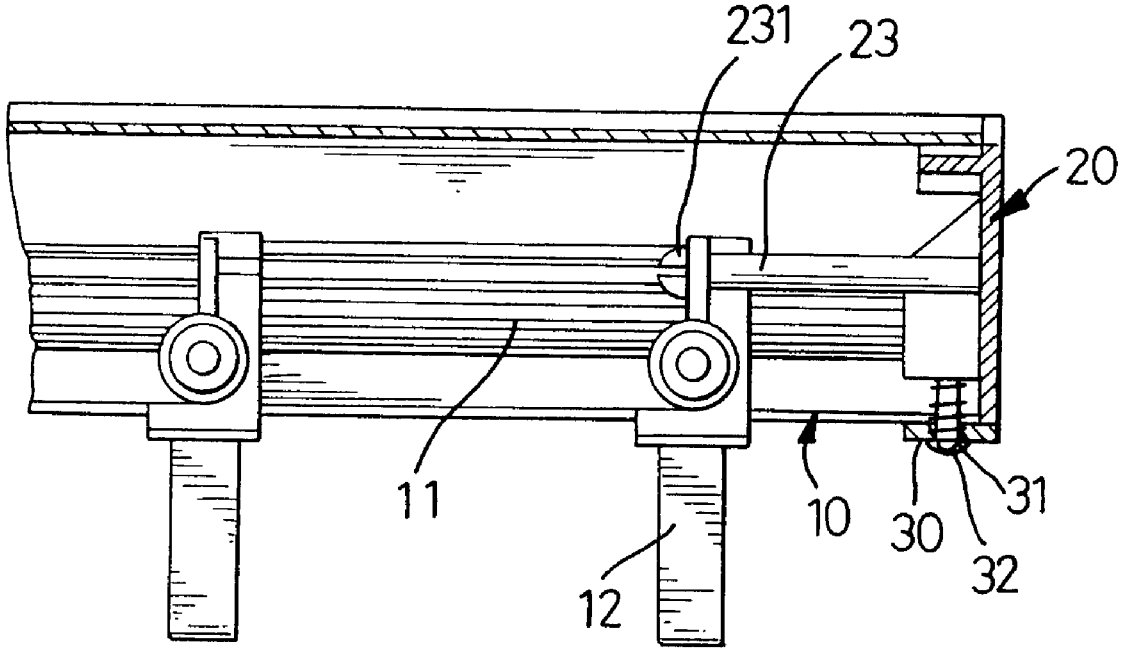
FIG. 2 is a front plan view of end piece secured in the end of the track in the vertical blind in FIG. 1.
Figure 3:
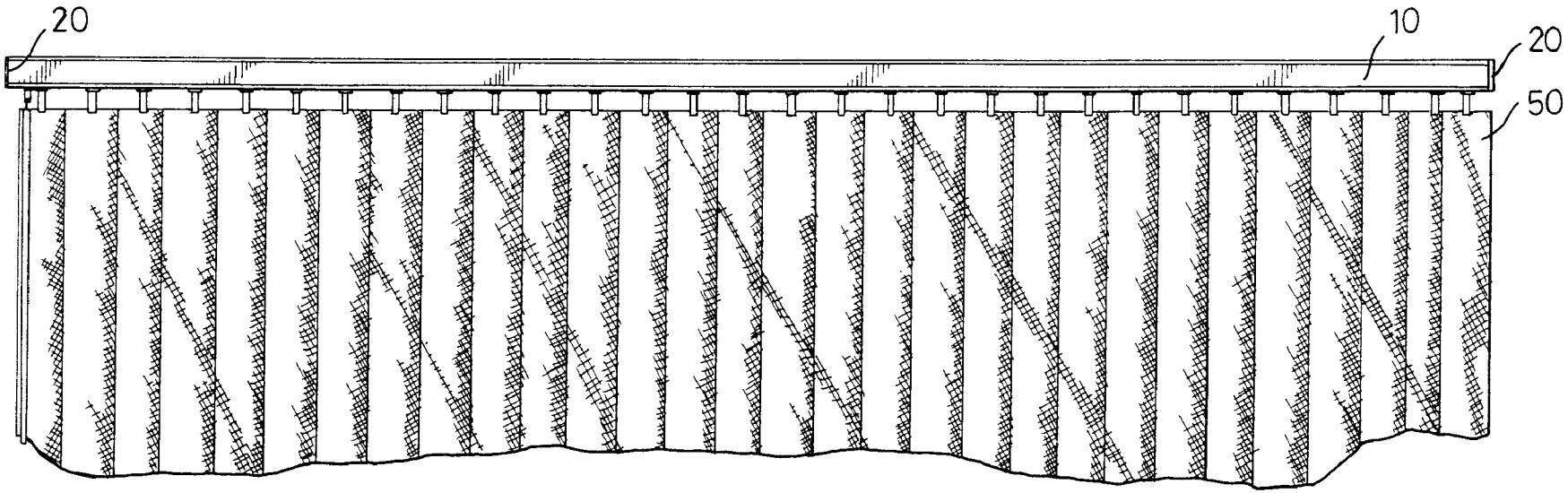
FIG. 3 is a front plan view of the vertical blind in accordance with the present invention.
Figure 4:
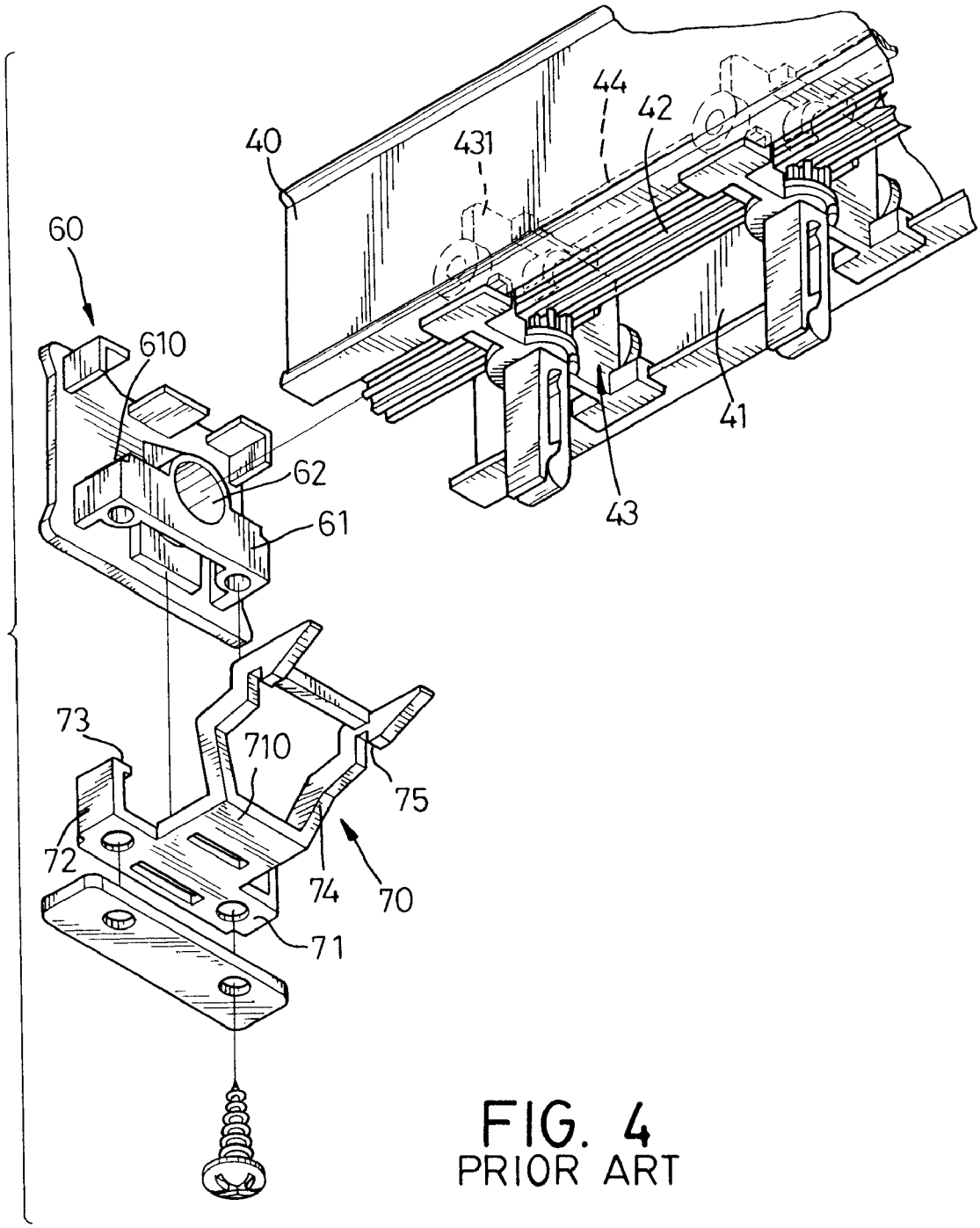
FIG. 4 PRIOR ART
FIG. 4 is a partially exploded perspective view of a conventional end piece and the track of the vertical blind in accordance with the prior art.
Figure 5:
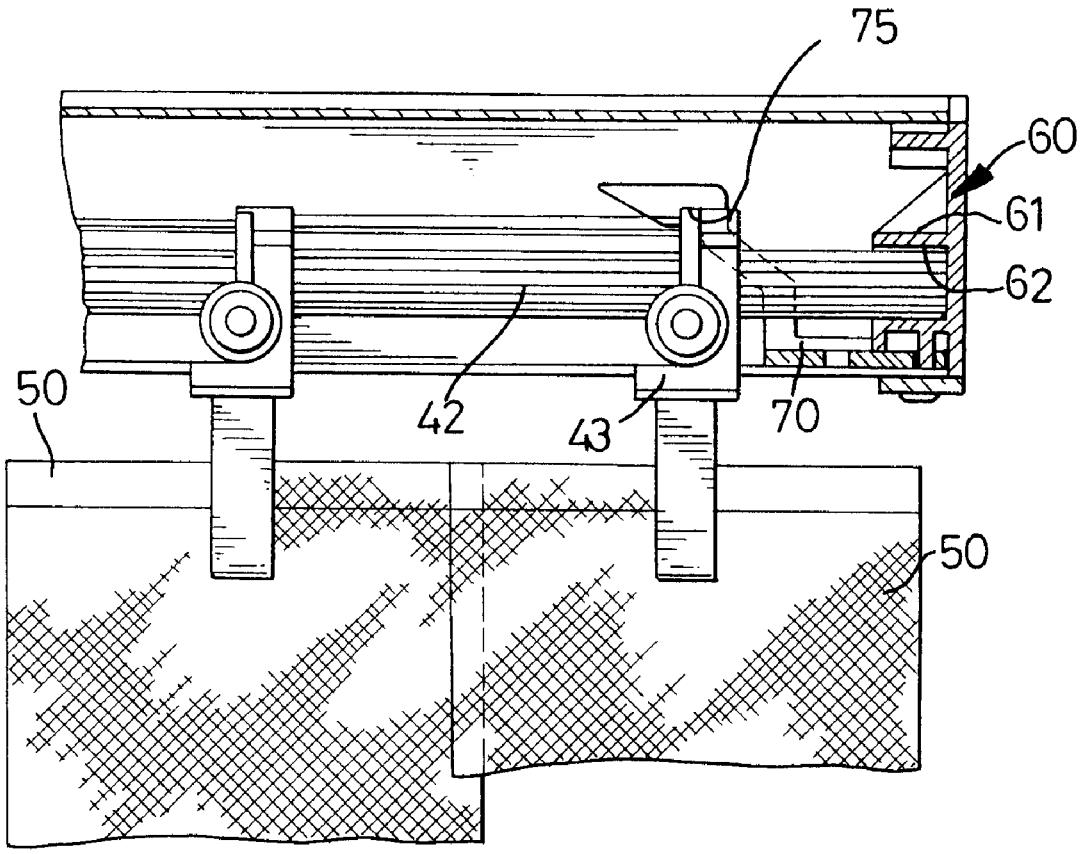
FIG. 5 PRIOR ART
FIG. 5 is a front plan view of the conventional end piece secured in the end of the track of the vertical blind.

With reference to FIGS. 1, 2 and 3, a vertical blind in accordance with the present invention comprises a track (10) adapted to be mounted on a ceiling, multiple clamps (12) partially slidably received in the track (10) to clamp vertical slats (50) and two end pieces (20) secured in two opposite ends of the track (10) and holding the nearest clamp (12) in place. A shaft (11) is rotatably received in the track (10) and has two ends each connected to a corresponding one of the end piece (20).

The track (10) is an inverted U-shape with two sidewalls and a slot (100) defined in the lower portion of the track (10). The clamp (12) has a shoulder (121) vertically formed relative to the side walls of the track (12) and moves in the track (10). The clamp (12) includes at least one through hole (122) horizontally defined in the shoulder (121).

With reference to FIGS. 1 and 2, the end piece (20) includes a faceplate (200) abutting and closing the end of the track (10). The end piece (20) includes a block (21) extending from the faceplate (200) and received in the track (10). The block (21) has two bores (22) defined and facing the slot (100) in the track (10). A recess (24) is defined in the block (21) to rotatably receive the end of the shaft (11) and hold the shaft (11) in place. The end piece (20) has at least one rod (23) extending perpendicular from the faceplate (200) and aligning with a corresponding one of the through hole (122) in the clamp (12). The rod (23) has an enlarged head (230) formed on the free end of the rod (23) and a groove (231) diametrically defined in the enlarged head (230). The enlarged head (230) of the rod (23) has a diameter greater than that of the through hole (122) of the clamp (12).

With reference to FIGS. 1, 2 and 3, to assemble the vertical blind, the enlarged head (230) on the rod (23) is inserted into the through hole (122) of the clamp (12) and pressed to squeeze and narrow the groove (231) be the periphery of the through hole (122) because the diameter of the through hole (122) is smaller than that of the enlarged head (230). The groove (231) of the enlarged head (230) restitutes to its original width after the enlarged head (230) passes through the through hole (122) in the clamp (12) to hold the clamp (12) and prevent the clamp (12) from detaching from the end piece (20). The vertical blind in accordance with the present invention comprises a positioning plate (30) having two holes (31) respectively defined to correspond to the two bores (22) in the end piece (20). The length of the positioning plate (30) is greater than that of the slot (100) in the track (10). A screw (32) extends through the hole (31) in the positioning plate (30) and is screwed into the bore (22) in the end piece (20) to secure the positioning plate (30) on the track (10) and hold the end piece (20) in place in the track (10).

As described above, the end piece (20) in accordance with the present invention is integrated, easily assembled and has a good structure so that the end piece saves a lot of money and time in manufacturing and assembly.

Although the invention has been explained in relation to its preferred embodiment, it is to be understood that many other possible modifications and variations can be made without departing from the spirit and scope of the invention as hereinafter claimed.

What is claimed is:

1. A vertical blind comprising:

a track adapted to be mounted on a ceiling, the track being an inverted U-shape with two sidewalls and a slot defined in a lower portion of the track;

multiple clamps partially slidably received in the track and clamping vertical slats, each clamp including a shoulder vertically formed relative to the sidewalls of the track and at least one through-hole defined in the shoulder parallel to the track;

two end pieces attached to two opposite ends of the track, each of the two end pieces including:

a faceplate abutting and closing the end of the track;

a block extending from the faceplate and received in the track;

at least one bore defined in the block and facing the slot in the track;

a recess defined in the block, the two recesses of the two end pieces facing each other; and at least one rod extending perpendicularly from the faceplate and aligning with the through-hole in a corresponding one of the multiple clamps, the rod having an enlarged head formed on a free end of the rod and a groove diametrically defined in the enlarged head, the enlarged head having a diameter greater than that of the through-hole of each clamp, the rod holding the nearest clamp in place after the enlarged head passes through the through-hole of the nearest clamp;

a shaft rotatably received in the track for adjusting an angle of the slats, the shaft having two ends each received in the recess in a corresponding one of the two end pieces; and a positioning plate secured on the block of the end piece and having at least one hole defined to correspond to at least one bore in the block, a screw extending through the hole and screwed into the bore of the end piece to secure the positioning plate on the end piece and clamping the track with the block to hold the end piece in place.

* * * * *